US009611184B2

(12) United States Patent
Waldock

(10) Patent No.: US 9,611,184 B2
(45) **Date of Patent: *Apr. 4, 2017**

(54) HEAVY ANFO AND A TAILORED EXPANDED POLYMERIC DENSITY CONTROL AGENT

(71) Applicant: LDE Corporation, Joplin, MO (US)

(72) Inventor: Kevin H. Waldock, Singleton (AU)

(73) Assignee: LDE Corporation, Joplin, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/062,068

(22) Filed: Mar. 5, 2016

(65) Prior Publication Data

US 2016/0176770 A1 Jun. 23, 2016

Related U.S. Application Data

(60) Continuation of application No. 14/252,334, filed on Apr. 14, 2014, now Pat. No. 9,290,418, which is a continuation of application No. 12/901,546, filed on Oct. 10, 2010, now Pat. No. 8,696,837, which is a division of application No. 11/163,211, filed on Oct. 10, 2005, now abandoned.

(51) Int. Cl.

| | |
|---|---|
| ***C06B 47/00*** | (2006.01) |
| ***C06B 31/00*** | (2006.01) |
| ***C06B 31/28*** | (2006.01) |
| ***D03D 23/00*** | (2006.01) |
| ***D03D 43/00*** | (2006.01) |
| ***C06B 23/00*** | (2006.01) |
| ***C06B 47/14*** | (2006.01) |
| ***C06B 45/00*** | (2006.01) |
| ***C06B 45/02*** | (2006.01) |

(52) U.S. Cl.

CPC ..... *C06B 31/285* (2013.01); *C06B 23/003* (2013.01); *C06B 45/00* (2013.01); *C06B 45/02* (2013.01); *C06B 47/145* (2013.01)

(58) Field of Classification Search

USPC ..... 149/46, 1, 45, 109.4

See application file for complete search history.

(56) References Cited

U.S. PATENT DOCUMENTS

| | | | |
|---|---|---|---|
| 4,181,546 | A | 1/1980 | Clay |
| 4,506,990 | A | 3/1985 | Neier et al. |
| 4,585,496 | A | 4/1986 | Honeyman et al. |
| 4,957,569 | A | 9/1990 | Waldock |
| 4,959,108 | A | 9/1990 | Waldock |
| 5,151,138 | A | 9/1992 | Lownds |
| 5,159,153 | A | 10/1992 | Cranney et al. |
| 5,244,475 | A | 9/1993 | Lownds et al. |
| 5,409,556 | A | 4/1995 | Lownds |
| 5,470,407 | A | 11/1995 | Griffith et al. |
| 5,505,800 | A | 4/1996 | Harries et al. |
| 5,675,119 | A | 10/1997 | Otani et al. |
| 6,027,588 | A | 2/2000 | Vattipalli et al. |
| 6,425,965 | B1 | 7/2002 | Silva |
| 7,971,534 | B2 | 7/2011 | Waldock |
| 9,290,418 | B2 * | 3/2016 | Waldock ..... C06B 23/003 |
| 2003/0051786 | A1 | 3/2003 | Verity |

FOREIGN PATENT DOCUMENTS

| | | | |
|---|---|---|---|
| CA | 1 331 514 | C | 8/1994 |
| CA | 2 127 302 | C | 1/1996 |
| EP | 0 330 637 | A1 | 8/1989 |
| RU | 2 111 197 | C1 | 5/1998 |
| WO | WO 00/78695 | A1 | 12/2000 |

* cited by examiner

*Primary Examiner* — James McDonough
(74) *Attorney, Agent, or Firm* — Christopher J. Kulish

(57) ABSTRACT

The present invention is directed to an explosive composition comprised of heavy ANFO and expanded polymeric beads that have a density that is less than the density of the heavy ANFO. The expanded polymeric beads have a size that is determined or based on the size of ammonium nitrate prills used in the heavy ANFO portion of the composition. In one embodiment, the expanded polymeric beads that are utilized in the composition are at least 70% of the lower limit of the mesh size of the predominant ammonium nitrate prill mesh size. In another embodiment, the expanded polymeric beads are at least 70% of a size that is related to the average mesh size of the ammonium nitrate prills.

6 Claims, No Drawings

HEAVY ANFO AND A TAILORED EXPANDED POLYMERIC DENSITY CONTROL AGENT

FIELD OF THE INVENTION

The present invention relates to explosive and, in particular, to an explosive composition that comprises a heavy ammonium nitrate fuel oil, i.e. a heavy ANFO.

BACKGROUND OF THE INVENTION

Heavy ANFO is comprised of an ammonium nitrate—fuel oil (ANFO) and a water-in-oil emulsion explosive. In many cases, a density reducing material is added to the heavy ANFO such that the combination of heavy ANFO and the density reducing material has a density that is lower than the heavy ANFO. The density reducing agent is needed because the density of the heavy ANFO is too high to reliably detonate. Among the materials that have been added to the heavy ANFO to adjust the density are wood meal, saw dust, bagasse, Styrofoam etc. In many cases, the combination of heavy ANFO and a density reducing agent still does not reliably detonate.

SUMMARY OF THE INVENTION

The present invention is directed to a an explosive composition comprising a heavy ANFO and expanded polymeric beads, the combination of which has a density that is less than the density of the heavy ANFO. The size of the expanded polymeric beads utilized in the composition is determined by the size or sizes of the ammonium nitrate prills used in the heavy ANFO. In one embodiment, the predominant prill size is used to determine the size of expanded polymeric bead that is used in the composition. In a specific embodiment, the polymeric beads are of a size that is at least 70% and no more than 200% of a size within the range of sizes held by the predominant prill mesh size. For example, if the prills that are held by a 12 mesh are predominant in the heavy ANFO, the mesh hold prills that are greater 1.70 mm and less than 2.00 mm in size. If the lower limit of this range (1.70 mm) is used, the expanded polymeric bead size used in the composition is between 1.19 mm and 3.40 mm. In another embodiment, the average prill size is used to determine the size of expanded polymeric bead. Utilizing expanded polymeric beads within the noted size range is believed to provide a more reliable explosive composition by avoiding run-up sensitivity and gap sensitivity problems.

The present invention is also directed to a method of making an explosive composition in which ANFO and a water-in-oil emulsion explosive are initially mixed with one another to form heavy ANFO. Expanded polymeric beads are subsequently added to the heavy ANFO. In one embodiment, the expanded polymeric beads have a size that is determined by the predominant or average size prill in the heavy ANFO. In another embodiment, the mixing of the ANFO, water-in-oil emulsion, and expanded polymeric beads is done in an end-to-end mixer.

DETAILED DESCRIPTION

The explosive composition is comprised of ammonium nitrate fuel oil ("ANFO"), a water-in-oil emulsion explosive, and expanded polymeric beads. The combination of ANFO and the water-in-oil emulsion explosive forms a heavy ANFO that is water resistant. The size of the polymeric beads is related to the size of ammonium nitrate prills in a manner that results in an explosive composition with improved reliability.

The ANFO component of the composition is comprised of ammonium nitrate prills and fuel oil. The ammonium nitrate prills are in a range of about 90-98% by weight of the ANFO component and the fuel oil is in a range of about 2-10% by weight of the ANFO component. In a preferred embodiment, the ammonium nitrate prills are about 94% by weight of the ANFO component and the fuel oil is about 6% by weight of the ANFO component. Typically, the fuel oil is No. 2 fuel oil. However, No. 1 fuel oil, mineral oil, other oils, and combinations of oils known to those in the art can also be employed.

The water-in-oil emulsion explosive component of the composition is comprised of: (a) a discontinuous aqueous phase comprising discrete droplets of an aqueous solution of one or more inorganic oxidizing salts; (b) a continuous water-immiscible organic phase throughout which the droplets are dispersed; and (c) one or more emulsifiers that form an emulsion of the droplets of the oxidizer salt solution throughout the continuous organic phase. Suitable inorganic oxidizing salts include ammonium nitrate, calcium nitrate, sodium nitrate, and combinations thereof. Other oxidizing salts known to those in the art are also feasible. Suitable organic fuels for use in the he continuous water-immiscible organic phase include fuel oil, mineral oil, waxes, and combinations thereof. Other organic fuels known to those in the art are also feasible. Suitable emulsifiers include sorbitan mono-oleate, sorbitan tristearate, sorbitan sesquiolette, polyisobutylene sulphonic acid, polyisobutylene succinic anhydride (PiBSA) derivatives of alkanolamines, and other emulsifiers known to those in the art.

The water-in-oil emulsion explosive has a density that is greater than 1.25 g/cc, preferably greater than 1.37 g/cc, and more preferably in a range of 1.40-1.55 g/cc. To enhance the water resistance of the composition, the water-in-oil emulsion explosive has a viscosity in the range of 22,000-60,000 cP (Brookfield Viscometer #7 spindle at 20 rpm and at 49° C.). Such viscosities are achieved by appropriate choice of the constituents of the emulsion explosive and the machining used to mix the constituents as is known in the art.

The heavy ANFO resulting from the combination of the ANFO with the water-in-oil emulsion explosive has a density greater that 1.26 g/cc. Preferably, the heavy ANFO has a density that is greater than about 1.40 g/cc. Typically, the ANFO is about 32-50% by weight of the heavy ANFO and the water-in-oil emulsion is about 50-68% by weight of the heavy ANFO.

The expanded polymeric beads component of the composition is used to lower the density of the combination of ANFO and the water-in-oil emulsion explosive (i.e., the heavy ANFO) such that the composition comprised of the ANFO, water-in-oil emulsion explosive, and expanded polymeric beads has a density that is lower than the density of the heavy ANFO. The polymeric beads have a density in the range of 0.008-0.080 g/cc. Preferably, the polymeric beads have a density in the range of 0.010-0.016 g/cc. The addition of the expanded polymeric beads to the heavy ANFO reduces the density of the resulting combination of heavy ANFO and expanded polymeric beads to 0.80-1.20 g/cc, depending on the amount of expanded polymeric beads that are added.

Suitable expanded polymeric beads include expanded polystyrene beads. However, expanded polyurethane beads, other expanded polymeric products known to those in the art, and combinations of such beads can also be utilized.

Typically, the expanded polymeric beads have a bead shape that is a substantially round or spherical shape.

The size of the expanded polymeric beads utilized in the composition is related to the size of the ammonium nitrate prills in the ANFO. To elaborate, the maximum dimension of an ammonium nitrate prill that is utilized in ANFO is typically 0.9-3.00 mm, which can also be expressed terms of mesh or sieve sizes as a minus 6 to plus 20 mesh. Prills as small as 0.5 mm are also occasionally used. Typically, prills are substantially spherical. The maximum dimension of such a prill is the diameter of the prill. Further, the ammonium nitrate prills used in ANFO typically have a range of mesh sizes. For example, a first percentage of the prills may have a mesh size of 10 and a second percentage of the prills may have a mesh size of 12. The size of the expanded polymeric beads that is utilized in the composition depends on the size or sizes of the prills.

In the situation in which prills with two or more mesh sizes are present in the ANFO component of the composition and prills of one mesh size of the two or more mesh sizes is predominant, the expanded polymeric beads have diameters that are at least 70% and as much as 200% of the predominant prill size. For example, if the prills are 20% 10 mesh, 35% 12 mesh, and 45% 14 mesh, the predominant mesh size is 14 mesh. In this example, the prills that are held by a 14 mesh are predominant. A prill that is held by a 14 mesh is greater than 1.40 mm and less than 1.70 mm. For convenience, the lower limit of the mesh size range is utilized in determining the appropriate size of expanded polymeric bead to utilize. In the example, the lower limit is 1.40 mm. Consequently, expanded polymeric beads are utilized that are in the range of 0.98-2.80 mm. Preferably, all of the expanded polymeric beads that are utilized in the composition have about the same diameters. It should be appreciated that the upper limit of the range for the predominant prill mesh size or any other size between the upper and lower limits of the predominant prill mesh size can be used to determine the size of the expanded polymeric bead.

Alternatively, the average prill mesh size is determined and expanded polymeric beads are utilized that are at least 70% and as much as 200% of the average prill size. For example, if the prills are 70% 10 mesh and 30% 16 mesh, the average mesh size is 11.8 mesh. An 11.8 mesh is about a 12 mesh. A prill that is held by a 12 mesh is greater than 1.70 mm and less than 2.00 mm. The lower limit of the size range held by a 12 mesh is 1.7 mm. Consequently, expanded polymeric beads are utilized that are in the range of 1.19-3.40 mm. Preferably, all of the expanded polymeric beads that are utilized in the composition have about the same diameter. It should be appreciated that, instead of rounding the average prill size up or down, interpolation can be utilized to determine a size in millimeters that is then used to determine the 70%-200% range of sizes for the expanded polymeric beads.

The manufacture of the explosive composition is accomplished by providing a mixing vessel and (a) adding the ANFO to the vessel followed by the addition of the oil-in-water emulsion explosive to the vessel; (b) adding the oil-in-water emulsion explosive to the vessel followed by the addition of ANFO to the vessel; or (c) simultaneously adding the ANFO and the oil-in-water emulsion explosive to the vessel. The ANFO and the oil-in-water emulsion explosive are mixed in the vessel to form heavy ANFO. The density of the resulting heavy ANFO is greater than about 1.25 g/cc and preferably greater than about 1.40 g/cc. After the ANFO and the oil-in-water emulsion explosive have been thoroughly mixed, the expanded polymeric beads are added to the heavy ANFO in a sufficient amount to produce the explosive composition with a desired density in the range of 0.80-1.20 g/cc. Preferably, the mixing of explosive composition occurs in a mixer of the type disclosed in U.S. Pat. No. 4,506,990, which is incorporated herein in its entirety, and in pending U.S. patent application Ser. No. 11/162,689, which is also incorporated herein in its entirety. Mixing of the explosive composition can also be accomplished in an auger. However, it is believed that adequate mixing of the composition can only be accomplished in augers exceeding 3.5-4.0 m in length.

The embodiments of the invention described herein are intended to describe the best mode known of practicing the invention and to enable others skilled in the art to utilize the invention.

What is claimed is:

1. An explosive composition comprising:

a heavy ANFO comprising ammonium nitrate prills, fuel oil, and a water-in-oil emulsion explosive; and expanded polymeric beads;

wherein the ammonium nitrate prills have one of: (a) a predominant prill mesh size and (b) an average prill mesh size;

wherein the water-in-oil emulsion explosive has a density greater than 1.25 g/cc;

wherein the expanded polymeric beads have a density in the range of 0.010-0.016 g/cc and a bead size that is at least 70% and no more than about 200% of one of: (a) a size in the range of the predominant prill mesh size and (b) the average prill mesh size.

2. An explosive composition, as claimed in claim 1, wherein:

the combination of the ammonium nitrate prills and the fuel oil is about 32-50% by weight of the heavy ANFO; and the water-in-oil emulsion explosive is about 50-68% by weight of the heavy ANFO.

3. An explosive composition, as claimed in claim 1, wherein:

the water-in-oil emulsion explosive has a density greater than about 1.30 g/cc.

4. An explosive composition, as claimed in claim 1, wherein:

the water-in-oil emulsion explosive comprises at least two inorganic oxidizing salts.

5. An explosive composition, as claimed in claim 1, wherein:

the water-in-oil emulsion explosive has a viscosity greater than 22,000 cP.

6. An explosive composition, as claimed in claim 1, wherein:

the explosive composition has a velocity of detonation in a range of 1600-3500 m/s in a 12.25" blast hole.

* * * * *